US005500060A

United States Patent [19]

Holt et al.

[11] Patent Number: 5,500,060

[45] Date of Patent: Mar. 19, 1996

[54] ENERGETIC PLASTICIZED PROPELLANT

[75] Inventors: Ronald B. Holt, Waltham Abbey; John C. M. Phillips, Bishops Stortford, both of England

[73] Assignee: Royal Ordnance plc, London, England

[21] Appl. No.: 39,893

[22] Filed: Mar. 29, 1993

Related U.S. Application Data

[63] Continuation of Ser. No. 754,933, Sep. 3, 1991, abandoned, which is a continuation of Ser. No. 629,111, Dec. 19, 1990, abandoned, which is a continuation of Ser. No. 466,708, Dec. 28, 1989, abandoned, which is a continuation of Ser. No. 300,646, Jan. 5, 1989, abandoned, which is a continuation of Ser. No. 81,799, Jul. 6, 1987, abandoned.

[30] Foreign Application Priority Data

Jul. 4, 1986 [GB] United Kingdom ..... 8616322

[51] Int. Cl.[6] ..... C06B 45/10

[52] U.S. Cl. ..... 149/19.1; 149/19.7; 149/19.8; 149/92; 149/105; 149/106

[58] Field of Search ..... 149/19.1, 19.7, 149/19.8, 92, 105, 106

[56] References Cited

U.S. PATENT DOCUMENTS

| | | | |
|---|---|---|---|
| 3,706,609 | 12/1972 | Voigt, Jr., et al. | 149/105 |
| 3,909,323 | 9/1975 | Flanagan et al. | 149/19.7 |
| 4,092,188 | 5/1978 | Lovelace | 149/92 |
| 4,284,442 | 8/1981 | Voigt | 149/19.4 |
| 4,394,197 | 7/1983 | Kabik et al. | 149/92 |
| 4,570,540 | 2/1986 | Bell | 149/19.7 |
| 4,657,607 | 4/1987 | Perotto et al. | 149/92 |
| 5,043,031 | 8/1991 | Redecker et al. | 149/19.1 |
| 5,067,996 | 11/1991 | Lundstrom et al. | 149/92 |

*Primary Examiner*—Edward A. Miller
*Attorney, Agent, or Firm*—Stevens, Davis, Miller & Mosher

[57] ABSTRACT

An energetic composition comprising the following components in the following relative proportions:

Component A: from 5% to 25% by weight of a polymeric binder;

Component B: from 65% to 90% by weight of a highly energetic filler comprising at least one heteroalicyclic nitramine compound; and Component C: from 1% to 15% by weight of a plasticiser which comprises at least one nitroaromatic compound; the percentages by weight of Components A, B and C adding to 100%.

2 Claims, No Drawings

ENERGETIC PLASTICIZED PROPELLANT

This application is a continuation of application Ser. No. 07/754,933, filed Sep. 3, 1991, now abandoned; which in turn is a continuation of application Ser. No. 07/629,111, filed Dec. 19, 1990, now abandoned; which in turn is a continuation of application Ser. No. 07/466,708, filed Dec. 28, 1989, now abandoned; which in turn is a continuation of application Ser. No. 07/300,646, filed Jan. 5, 1989, now abandoned; which in turn is a continuation of application Ser. No. 07/081,799, filed Jul. 6, 1987, now abandoned.

The present invention relates to energetic materials, particularly polymer bonded explosives and gun propellants and compositions suitable therefor.

Gun propellants have for many years been produced from compositions containing blends of nitrocellulose and nitroglycerine and are therefore known as double base materials. In some cases additional energetic ingredients such as picrite are added and the propellants are known as triple compositions. For high energy applications, e.g. the propulsion of kinetic energy projectiles from an armoured tank gun, highly energetic components such as nitramines have been included in double and triple base compositions.

Double and triple base compositions, particularly for high energy applications, suffer from the disadvantage that they are highly vulnerable to unwanted ignition when subjected in a hostile environment to attack by an energetic projectile, e.g. a projectile comprising a shaped warhead charge.

Recent approaches to the problem of vulnerability have involved the development of compositions which are essentially non-double base or-triple base systems. Although such systems can provide reduced vulnerability this is, in general terms, obtained at the expense of propellant energy.

It is an object of the present invention to provide improved insensitive energetic materials, especially plastic bonded explosives and gun propellant compositions for low vulnerability applications.

According to the present invention there is provided an energetic composition comprising the following components in the following relative proportions:

Component A: from 5% to 25% by weight of a polymeric binder;

Component B: from 65% to 90% by weight of a highly energetic filler comprising at least one heteroalicyclic nitramine compound; and Component C: from 1% to 15% by weight of a plasticiser which comprises at least one nitroaromatic compound; the percentages by weight of Components A, B and C adding to 100%.

In compositions according to the present invention Component B essentially provides the high energy capability of the composition (although Component C makes and optionally Component A may make a minor contribution), Component A provides the required structural binder properties and Component C provides processibility enabling mixtures to be formed together with Components A and B and which may be worked into a suitable dough-like material which may be pressed or extruded to form suitable products, e.g., propellants. The mutual combination of these components is specially selected in compositions according to the present invention because of the unexpected advantages such a combination provides as follows.

We have found that compositions according to the present invention can be suitably processed to provide energetic materials, e.g., for use propellants which unexpectedly and beneficially can show an improved vulnerability but without a corresponding decrease in energy normally associated with such an improvement.

For example, propellant compositions embodying the present invention generally have a high ignition temperature and possess also the beneficial properties of relatively low flame temperatures for the level of energy involved, thereby affording the possibility of reduced barrel erosion, as well as a relatively low burning rate, the latter property beneficially allowing propellants to be made with small web sizes as described below. The compositions according to the present invention therefore can have a combination of properties which are especially suitable for the formulation of propellants for low vulnerability applications.

Preferably Component A comprises from 10% to 25% by weight, Component B comprises 70% to 90% by weight and Component C comprises 3% to 12% by weight, of the said composition.

Component C preferably comprises one or more compounds which melt at a temperature less than 100° C. and desirably is a liquid at room temperature (20° C.). Preferably, the or each said nitro compound of Component C is a monocyclic nitroaromatic compound; it may be a mononitro compound but preferably is a di- or tri-nitro compound or a mixture thereof.

Especially suitable as compounds for use in or as Component C are di- and tri-nitro benzenes or alkyl- or alkoxybenzenes optionally containing substituent groups in the aromatic ring or in the alkyl or alkoxy group(s). For example, the compound may be a di- or tri-nitro derivative of an optionally substituted alkyl- or alkoxy-benzene containing from 1 to 3 optionally substituted alkyl and/or alkoxy groups each having from 1 to 4 carbon atoms. The compound may for instance be a di- or tri-nitro derivative of an optionally substituted toluene, ethylbenzene, propylbenzene, butylbenzene, xylene, methylethylbenzene, diethylbenzene or mesitylene or one of the other families to which the compounds listed below belong.

As optional substituents for the aromatic ring in addition to nitro group(s) and alkyl or alkoxy group(s) where present in the said nitroaromatic compound(s) of Component C, are preferred groups other than halogens selected from OH, SH, $N_3$, $NR_1R_2$, $CO.OR_3$ or $O.OCR_4$ where $R_1$, $R_2$, $R_3$ and $R_4$ are each independently H or a simple alkyl or alkoxy (containing from 1 to 4 carbon atoms) or phenyl.

Component C may for example comprise one or more of the following known compounds (where M.P./° C. is the melting point in degrees Celsius):

| Compound No. | Name | M.P./°C. |
|---|---|---|
| 1 | 1-amino-2,4-dimethyl-3-nitrobenzene | 81–82 |
| 2 | 1-amino-3,4-dimethyl-2-nitrobenzene | 65–66 |
| 3 | 1-amino-3,5-dimethyl-2-nitrobenzene | 56 |
| 4 | 2-amino-1,3-dimethyl-4-nitrobenzene | 81–82 |
| 5 | 2-amino-1,5-dimethyl-3-nitrobenzene | 76 |
| 6 | 5-amino-1,2-dimethyl-3-nitrobenzene | 74–75 |
| 7 | 1-amino-2-methoxy-3-nitrobenzene | 67 |
| 8 | 1,3-dihydroxy-2-nitrobenzene | 87–88 |
| 9 | 1,2-dimethoxy-3-nitrobenzene | 64–65 |
| 10 | 1,2-dimethoxy-4-nitrobenzene | 98 |
| 11 | 1,3-dimethoxy-2-nitrobenzene | 89 |
| 12 | 1,4-dimethoxy-2-nitrobenzene | 72–73 |
| 13 | 2,4-dimethoxy-1-nitrobenzene | 76–77 |
| 14 | 1,2-dimethyl-3,4-dinitrobenzene | 82 |
| 15 | 1,2-dimethyl-3,5-dinitrobenzene | 77 |
| 16 | 1,3-dimethyl-2,5-dinitrobenzene | 101 |
| 17 | 1,4-dimethyl-2,3-dinitrobenzene | 93 |
| 18 | 2,3-dimethyl-1,4-dinitrobenzene | 89–90 |
| 19 | 1,2-dimethyl-4-hydroxy-5-nitrobenzene | 87 |
| 20 | 1,3-dimethyl-2-hydroxy-4-nitrobenzene | 99–100 |
| 21 | 1,4-dimethyl-2-hydroxy-3-nitrobenzene | 34–35 |

-continued

| Compound No. | Name | M.P./°C. |
|---|---|---|
| 22 | 1,5-dimethyl-2-hydroxy-3-nitrobenzene | 73 |
| 23 | 1,5-dimethyl-3-hydroxy-2-nitrobenzene | 66–66.5 |
| 24 | 2,5-dimethyl-1-hydroxy-3-nitrobenzene | 91 |
| 25 | 1,2-dimethyl-3-nitrobenzene | 15 |
| 26 | 1,2-dimethyl-4-nitrobenzene | 30–31 |
| 27 | 1,3-dimethyl-2-nitrobenzene | 13 |
| 28 | 1,3-dimethyl-5-nitrobenzene | 75 |
| 29 | 1,4-dimethyl-2-nitrobenzene | — |
| 30 | 2,4-dimethyl-1-nitrobenzene | 9 |
| 31 | 1,3-dinitrobenzene | 90 |
| 32 | 1,3-dinitro-2-ethoxybenzene | 59.5–60.5 |
| 33 | 1,3-dinitro-5-ethoxybenzene | 97.5 |
| 34 | 1,4-dinitro-2-ethoxybenzene | 96–98 |
| 35 | 2,4-dinitro-1-ethoxybenzene | 86–87 |
| 36 | 1,3-dinitro-5-isopropyl-4-hydroxy--6-methylbenzene | 55.5 |
| 37 | 1,2-dinitro-4-methoxybenzene | 71 |
| 38 | 1,3-dinitro-5-methoxybenzene | 205.5 |
| 39 | 1,4-dinitro-2-methoxybenzene | 97 |
| 40 | 2,4-dinitro-1-methoxybenzene | 94.5–95.5 |
| 41 | 2,4-dinitro-1,3,5-trimethyl-benzene | 86 |
| 42 | 1-ethoxy-2-nitrobenzene | 2 |
| 43 | 1-ethoxy-4-nitrobenzene | 60 |
| 44 | 1-ethyl-2-nitrobenzene | –23 |
| 45 | 1-ethyl-3-nitrobenzene | — |
| 46 | 1-ethyl-4-nitrobenzene | –12 |
| 47 | 1-isobutoxy-2-nitrobenzene | (oil) |
| 48 | 4-isopropyl-1-methyl-2-nitrobenzene | — |
| 49 | 1-isopropyl-2-nitrobenzene | — |
| 50 | 1-isopropyl-4-nitrobenzene | — |
| 51 | 1-mercapto-2-nitrobenzene | 58.5 |
| 52 | 1-mercapto-4-nitrobenzene | 79 |
| 53 | 1-methoxy-2-nitrobenzene | 10 |
| 54 | 1-methoxy-3-nitrobenzene | 38–39 |
| 55 | 1-methoxy-4-nitrobenzene | 54 |
| 56 | 2-methoxy-1,3,5-trinitrobenzene | 69 |
| 57 | nitrobenzene | 5.7 |
| 58 | 1-nitro-2-triazobenzene | 53–55 |
| 59 | 1-nitro-3-triazobenzene | 56 |
| 60 | 1-nitro-4-triazobenzene | 75 |
| 61 | 1-nitro-2,3,5-trimethylbenzene | 20 |
| 62 | 1-nitro-2,4,5-trimethylbenzene | 71 |
| 63 | 2-nitro-1,3,5-trimethylbenzene | 44 |
| 64 | 1,2,4-trinitrobenzene | 61–62 |
| 65 | 1,3,5-trinitrobenzene | — |
| 66 | N-(2-nitrophenyl)-benzamide | 98 |
| 67 | 2-nitrophenyl benzoate | 85 |
| 68 | 3-nitrophenyl benzoate | 71–72 |
| 69 | 4-nitrophenyl benzoate | 94–95 |
| 70 | 2,4-dinitrotoluene | 71 |
| 71 | 2,5-dinitrotoluene | 53 |
| 72 | 2,6-dinitrotoluene | 66 |
| 73 | 3,4-dinitrotoluene | 58 |
| 74 | 2,4-dinitro-6-hydroxytoluene | 86 |
| 75 | 3,5-dinitro-4-hydroxytoluene | 85 |
| 76 | 2-hydroxy-3,4,5-trinitrotoluene | 102 |
| 77 | 3-hydroxy-2,4,6-trinitrotoluene | 109–110 |
| 78 | 2,4,6-trinitrotoluene | 82 |

Preferably, at least 50% by weight of Component C comprises one or more alkyl substituted monocyclic dinitrobenzenes, e.g. selected from dinitrotoluenes, dinitroethylbenzenes and dinitropropylbenzenes.

Nitroaromatic compounds as described above have been found to provide energetic plasticisers which are compatible with nitramine energetic fillers and are highly suitable for use in processing mixtures of such fillers with polymeric binders. Preferably, the nitroaromatic plasticiser has an ignition temperature greater than 200° C.

Nitroaromatic compounds as described above are known or may be made by well known methods.

For example, in the production of nitro derivatives of alkylbenzenes the appropriate alkylbenzene is treated with concentrated nitric and sulphuric acid at a temperature less than 40° C. Where the product obtained is a mixture of nitro compounds, e.g. containing dinitro- and trinitro derivatives, such a mixture may itself be suitable for use in or as Component C.

Although Component C desirably comprises one or more monocyclic nitroaromatic compounds, e.g. so that the monocyclic nitro compound(s) forms at least 50 per cent by weight of Component C, it may also include one or more nitroaromatic compounds containing more than one aromatic ring, e.g. one or more of the 2-ring esters listed above or one or more nitro derivatives of biphenyl, naphthalene diphenylmethane, bibenzyl or stilbene preferably containing two or three nitro groups in each ring. An example is 2,2',4,4',6,6'-hexanitrostilbene.

Although Component C is preferably constituted entirely by nitroaromatic compounds as described above it could also include other energetic and non-energetic plasticisers as optional additives. For example, Component C may additionally include a quantity of one or more known energetic plasticisers such as GAP (glycidyl azide polymer), BDNPA/F (bis-2,2-dinitropropylacetal/formal), dimethylmethylene dinitroamine, bis(2,2-dinitropropyl)formal, bis(2,2,2-trinitroethyl)formal, bis(2-fluoro-2,2-dinitroethyl)formal, diethylene glycol dinitrate, glycerol trinitrate, glycol trinitrate, triethylene glycol dinitrate, tetrethylene glycol dinitrate, trimethylolethane trinitrate, butanetriol trinitrate, or 1,2,4-butanetriol trinitrate. Alternatively, or in addition, Component C may include one or more known non-energetic plasticisers such as dialkyl esters of adipic or phthalic acid, e.g., dibutyl phthalate, or diethyl phthalate, triacetin, tricresyl phosphate, polyalkylene glycols and their alkyl ether derivatives, e.g. polyethylene glycol, polypropylene glycol, and diethylene glycol butylether. However, preferably at least 50% desirably at least 75% by weight of Component C is constituted by one or more nitroaromatic compounds.

In the composition according to the present invention Component A may be any suitable polymer binder. It may comprise an inert binder material, an energetic binder material or a blend of inert and energetic binder materials. However, generally speaking, increasing the energetic nature of the binder increases the sensitiveness and-explosiveness of the energetic material formed therefrom. Therefore employed binders which are energetic are desirably not highly energetic. For example where the binder comprises a blend of inert and energetic materials the inert material preferably forms at least 50% by weight of the binder.

Examples of suitable inert or non-energetic binder materials are cellulosic materials such as esters, e.g. cellulose acetate, cellulose acetate butyrate, polyurethanes, polyesters, polybutadienes, polyethylenes, polyvinyl acetate and blends and/or copolymers thereof.

Examples of suitable energetic binder materials are nitrocellulose, polyvinyl nitrate, nitroethylene, nitroallyl acetate, nitroethyl acrylate, nitroethyl methacrylate, trinitroethyl acrylate, dinitropropyl acrylate, C-nitropolystyrene and its derivatives, polyurethanes with aliphatic C- and N- nitro groups, polyesters made from dinitrocarboxylic acids and dinitrodiols.

We prefer cellulosic materials for Component A comprising 0 to 60 per cent by weight of nitrocellulose, e.g., containing 12 to 14 per cent by weight N, and 100 to 40 per cent by weight of an inert cellulose ester, e.g., cellulose acetate, or cellulose acetate butyrate.

Preferably, Component B comprises a solid granular or powdered material which can be uniformly incorporated in Component A.

Preferably at least 75% desirably at least 90% by weight of Component B is constituted by one or more heteroalicyclic nitramine compounds. Nitramine compounds are those containing at least one N-$NO_2$ group. Heteroalicyclic nitramines bear a ring containing N-$NO_2$ groups. Such ring or rings may contain for example from two to ten carbon atoms and from two to ten ring nitrogen atoms. Examples of preferred heteroalicyclic nitramines are RDX (cyclo -1,3,5-trimethylene-2,4,6-trinitramine, cyclonite or Hexagen), HMX (cyclo -1,3,5,7-tetramethylene -2,4,6,8-tetranitramine, Octogen) or TATND (tetranitro-tetraminodecalin) and mixtures thereof.

Preferably, Component B comprises from 50% to 100% by weight of RDX. Desirably, for propellants, the composition includes from 70 to 80 per cent by weight of RDX.

Other highly energetic filler materials may be added to the nitramine(s) of Component B, the non-nitramine component(s) providing up to 25 per cent by weight of Component B. Examples of suitable known highly energetic materials include picrite (nitroguanidine), TAGN, aromatic nitramines such as tetryl, ethylene dinitramine, and nitrate esters such as nitroglycerine (glycerol trinitrate), butane triol trinitrate or pentaerythrital tetranitrate.

Various known additives may be added to the compositions according to the present invention comprising Components A, B and C as specified above. Preferably, the additive content comprises no more than 10 per cent by weight, desirably less than 5 per cent by weight, of the combined mixture when formed into a propellant.

The additive may for example comprise one or more stabilisers, e.g. carbamite or PNMA (para-nitro-methyl-methoxyaniline); and/or one or more ballistic modifiers, e.g. carbon black or lead salts; and/or one or more flash suppressants, e.g. one or more sodium or potassium salts, e.g. sodium or potassium sulphate or bicarbonate.

Preferred compositions embodying the invention for use as gun propellants comprise:

| | |
|---|---|
| nitrocellulose | 8 to 10 per cent by weight |
| cellulose acetate butyrate | 6 to 12 per cent by weight |
| RDX | 70 to 80 per cent by weight |
| nitroaromatic plasticiser | 5 to 10 per cent by weight |
| carbamite diethyl-diphenyl-urea stabiliser | 1 per cent by weight |

In this composition, the nitroaromatic plasticiser is preferably selected from one of the following:

| | |
|---|---|
| (a) a mixture of dinitroethylbenzene and trinitroethylbenzene containing: | |
| dinitroethyl- | 50–64 per cent by weight |
| benzene trinitroethylbenzene | 36–50 per cent by weight; |
| (b) 2,4-dinitrotoluene; | |
| (c) 4,6-dinitro-o-cresol; | |
| (d) 2,4-dinitro-m-xylene; | |

Compositions according to the present invention may be processed into products such as propellants by techniques which are known to those skilled in the art. The plasticiser comprising Component C is added to and absorbed by the polymer of Component A to swell and soften the polymer. If Component C includes a solid it may be melted and then added to Component A or added in a suitable solvent, e.g. acetone or ethyl acetate. Component B, preferably in a paste with an organic solvent, is blended with a mixture of Components A and C in a suitable kneader to form a homogeneous composition. Eventually, the composition produced is pressed or extruded in the form of a dough-like material through suitably shaped extrusion dies. The extrusion may be carried out using a co-rotating twin screw extrusion machine.

The product obtained by extrusion of compositions according to the present invention may be obtained in any suitable form. For example, where the product is a gun propellant, it may be obtained in the form of sticks or granules of known shape. Sticks are usually formed by cutting to a suitable length rods or strands extruded through suitable dies giving a shape including a longitudinal slot. Granules are usually similarly formed by cutting to much shorter lengths rods or sticks obtained by extrusion. Normally such granules have small holes, e.g. seven holes running lengthwise therethrough to provide suitable burning surfaces.

An important feature of certain propellant products is the web size of the product shape or configuration. This parameter, well known to those skilled in the propellants art, is the minimum thickness of propellant to be burnt through from one surface to another. For example, for a propellant product having simple tube configuration, the web thickness is the outer to inner wall thickness of the cross-sectional annulus of the tube. Web sizes of propellant products incorporating compositions embodying the invention may vary over a range according to the specific application, e.g. from 0.5 mm to 4.0 mm, although the more desirable web sizes at the lower end of this range, e.g. from 0.5 mm to 2.0 mm, will generally be suitable for most applications because the compositions generally have a low burning rate.

Examples of compositions embodying the invention and their use in the production of propellant materials will now be described.

In the following examples the appropriate Components A, B and C (as defined above) are prepared by known methods. These components are then formed into propellant products in the following general way which is known per se. The solid components comprising Component A and any minor additives, e.g. stabiliser and/or flame suppressant, are loaded as a powder into an incorporator (blender) whose blades have previously been moistened with an organic solvent. The viscous liquid comprising Component C is added to a solvent and the mixture is poured into the incorporator to which further solvent is then added. The mixture is then incorporated together for 30 minutes after which further solvent is added and the mixture is subsequently further blended for 4 hours. Cold water is continuously run through the incorporator during blending.

After processing in the incorporator the mixture formed is dried in an oven at a temperature of typically 50°–90° C. for a period of several hours and subsequently pressed or extruded into strands of the required shape and web size which or cut into appropriate lengths as will be readily apparent to those skilled in the art.

Products embodying the present invention comprising compositions of the following components may be made in the manner described above. In the following compositions "Nitrocellulose" means nitrocellulose containing 12.6% by weight N.

| | Ingredient | | Percentage by weight |
|---|---|---|---|
| Composition 1 | | | |
| Component A | Cellulose acetate | | 20 |
| Component B | RDX | | 71 |
| Component C | 2,4-dinitrotoluene | | 8 |
| | Carbamite | | 1 |
| Compositions 2 to 75 | | | |
| Component A | Cellulose acetate | | 20 |
| Component B | RDX | | 71 |
| Component C | 2,4-dinitrotoluene | | 4 |
| | Compound X* | | 4 |
| | Carbamite | | 1 |
| Composition 76 | | | |
| Component A | Cellulose acetate butyrate | | 15 |
| | Nitrocellulose | | 5 |
| Component B | RDX | | 71 |
| Component C1 | | | 9 |
| wherein Component C1 comprises: | | | |
| | 2,6-dinitrotoluene | 10 pbw | |
| | 2,4-dinitrotoluene | 45 pbw | |
| | 2,4,6-trinitrotoluene | 45 pbw | |
| (where pbw = parts by weight) | | | |
| Composition 77 | | | |
| Component A | Cellulose acetate butyrate | | 15 |
| | Nitrocellulose | | 5 |
| Component B | RDX | | 71 |
| Component C2 | | | 9 |
| wherein Component C2 comprises: | | | |
| | 2,6-dinitrotoluene | 2 pbw | |
| | 2,4-dinitrotoluene | 54 pbw | |
| | 2,4,6-trinitrotoluene | 44 pbw | |
| Composition 78 | | | |
| Component A | Cellulose acetate butyrate | | 15 |
| | Nitrocellulose | | 5 |
| Component B | RDX | | 71 |
| Component C3 | | | 9 |
| wherein Component C3 comprises: | | | |
| | 2,6-dinitrotoluene | 2 pbw | |
| | 2,4-dinitrotoluene | 64 pbw | |
| | 2,4,6-trinitrotoluene | 34 pbw | |
| Composition 79 | | | |
| Component A | Cellulose acetate butyrate | | 15 |
| | Nitrocellulose | | 5 |
| Component B | RDX | | 71 |
| Component C4 | | | 9 |
| wherein Component C4 comprises: | | | |
| | 2,6-dinitro-1-ethylbenzene | 10 pbw | |
| | 2,4-dinitro-1-ethylbenzene | 45 pbw | |
| | 2,4,6-trinitro-1-ethylbenzene | 45 pbw | |
| Composition 80 | | | |
| Component A | Cellulose acetate butyrate | | 15 |
| | Nitrocellulose | | 5 |
| Component B | RDX | | 71 |
| Component C5 | | | 9 |
| wherein Component C5 comprises: | | | |
| | 2,6-dinitro-1-ethylbenzene | 2 pbw | |
| | 2,4-dinitro-1-ethylbenzene | 54 pbw | |
| | 2,4,6-trinitro-1-ethylbenzene | 44 pbw | |
| Composition 81 | | | |
| Component A | Cellulose acetate butyrate | | 15 |
| | Nitrocellulose | | 5 |
| Component B | RDX | | 71 |
| Component C6 | | | 9 |

-continued

| Ingredient | | | Percentage by weight |
|---|---|---|---|
| wherein Component C6 comprises: | | | |
| 2,6-dinitro-1-ethylbenzene | | 2 pbw | |
| 2,4-dinitro-1-ethylbenzene | | 64 pbw | |
| 2,4,6-trinitro-1-ethylbenzene | | 34 pbw | |
| Composition 82 | | | |
| Component A | Cellulose acetate butyrate | | 15 |
| | Nitrocellulose | | 5 |
| Component B | RDX | | 71 |
| Component C7 | | | 9 |
| wherein Component C7 comprises: | | | |
| 1-isopropyl-2,6-dinitrobenzene | | 10 pbw | |
| 1-isopropyl-2,4-dinitrobenzene | | 45 pbw | |
| 1-isopropyl-3,4,6-trinitrobenzene | | 45 pbw | |
| Composition 83 | | | |
| Component A | Cellulose acetate butyrate | | 15 |
| | Nitrocellulose | | 5 |
| Component B | RDX | | 71 |
| Component C8 | | | 9 |
| wherein Component C8 comprises: | | | |
| 1-isopropyl-2,6-dinitrobenzene | | 2 pbw | |
| 1-isopropyl-2,4-dinitrobenzene | | 54 pbw | |
| 1-isopropyl-3,4,6-trinitrobenzene | | 44 pbw | |
| Composition 84 | | | |
| Component A | Cellulose acetate butyrate | | 15 |
| | Nitrocellulose | | 5 |
| Component B | RDX | | 71 |
| Component C9 | | | 9 |
| wherein Component C9 comprises: | | | |
| 1-isopropyl-2,6-dinitrobenzene | | 2 pbw | |
| 1-isopropyl-2,4-dinitrobenzene | | 64 pbw | |
| 1-isopropyl-3,4,6-trinitrobenzene | | 34 pbw | |
| Composition 85 | | | |
| Component A | Cellulose acetate butyrate | | 12 |
| | Nitrocellulose | | 8.2 |
| Component B | RDX | | 73.8 |
| Component C6 | | | 5 |
| Component D | Carbamite | | 1 |
| wherein Component C6 is as defined above. | | | |
| Composition 86 | | | |
| Component A | Cellulose acetate butyrate | | 12 |
| | Nitrocellulose | | 8.2 |
| Component B | RDX | | 73.8 |
| Component C10 | | | 5 |
| Component D | Carbamite | | 1 |
| wherein Component C10 comprises: | | | |
| 2,6-dinitro-1-ethylbenzene | | 2 pbw | |
| 2,4-dinitro-1-ethylbenzene | | 48 pbw | |
| 2,4,6-trinitro-1-ethylbenzene | | 50 pbw | |
| Composition 87 | | | |
| Component A | Cellulose acetate butyrate | | 8 |
| | Nitrocellulose | | 10 |
| Component B | RDX | | 72 |
| Component C10 | | | 9 |
| Component D | Carbamite | | 1 |
| wherein Component C10 is as defined above. | | | |
| Composition 88 | | | |
| Component A | Cellulose acetate butyrate | | 6 |
| | Nitrocellulose | | 8 |
| Component B | RDX | | 77 |
| Component C10 | | | 8.5 |
| Component D | Carbamite | | 0.5 |
| wherein Component C10 is as defined above. | | | |
| Composition 89 | | | |
| Component A | Cellulose acetate butyrate | | 12 |

-continued

| | Ingredient | Percentage by weight |
|---|---|---|
| | Nitrocellulose | 8.2 |
| Component B | RDX | 73.8 |
| Component C | 4,6-dinitro-o-cresol | 5 |
| Component D | Carbamite | 1 |
| Composition 90 | | |
| Component A | Cellulose acetate butyrate | 12 |
| | Nitrocellulose | 8.2 |
| Component B | RDX | 73.8 |
| Component C | 2,4-dinitrotoluene | 5 |
| Component D | Carbamite | 1 |
| Composition 91 | | |
| Component A | Cellulose acetate butyrate | 12 |
| | Nitrocellulose | 8.2 |
| Component B | RDX | 73.8 |
| Component C | 2,4-dinitro-m-xylene | 5 |
| Component D | Carbamite | 1 |

*wherein X is successively 1 to 68 and 70 to 75 as listed above

Compositions 1 to 91 show energy levels which are in the approximate range of 1100–1300 Joules per gram. As noted above double base compositions generally show a lower ignition temperature and lower vulnerability at the same respective energy levels.

Examples of the properties of some of the above compositions are given in Table 1 as follows, wherein E=propellant energy in KJ per Kg, T=propellant flame temperature in degrees Kelvin, d=density in grammes per $cm^3$.

TABLE 1

Properties of Examples of Compositions

| Composition No. | E | T | d |
|---|---|---|---|
| 85 | 1178 | 3088 | 1.689 |
| 86 | 1182 | 3143 | 1.689 |
| 87 | 1216 | 3241 | 1.691 |
| 88 | 1279 | 3453 | 1.706 |
| 89 | 1170 | 3092 | 1.686 |
| 90 | 1174 | 3123 | 1.671 |
| 91 | 1168 | 3054 | 1.671 |

Compositions 1 to 91 show ignition temperatures which are 20–30 degrees Celsius or more above those of known double base and triple base compositions of the same energy level.

For example, a composition comprising:

| | |
|---|---|
| nitroglycerine | 32% by weight |
| nitrocellulose | 32% by weight |
| picrite | 35% by weight |
| carbamite | 1% by weight |

has a similar energy level to that of Composition 85, but its ignition temperature, 161° C., is significantly lower than the ignition temperature, 226° C., of Composition 85.

We claim:

1. An energetic composition comprising the following components in the following relative properties:

Component A: from 5% to 25% by weight of a polymeric binder;

Component B: from 65% to 90% by weight of a highly energetic filler comprising at least one heteroalicyclic nitramine compound; and Component C: from 1% to 15% by weight of a plasticiser which comprises two or more nitroaromatic compounds; the percentages by weight of Components A, B and C adding to 100%.

2. An energetic composition comprising the following components in the following relative proportions:

Component A: from 5% to 25% by weight of a polymeric binder;

Component B: from 65% to 90% by weight of a highly energetic filler comprising at least one heteralicyclic nitramine compound; and Component C: from 1% to 15% by weight of a plasticizer which comprises:

a mixture of dinitroethylbenzene and trinitroethylbenzene containing:

dinitroethylbenzene 50 to 64 percent by weight trinitroethylbenzene 36 to 50 percent by weight;

the percentages by weight of Components A, B and C adding to 100%.

* * * * *